United States Patent [19]

Wotton

[11] Patent Number: 4,892,650

[45] Date of Patent: Jan. 9, 1990

[54] FRUIT GRADING MACHINE

[75] Inventor: Phillip J. Wotton, Carey Gully, Australia

[73] Assignee: Belt-Ton Grading Pty., Ltd., So. Australia, Australia

[21] Appl. No.: 255,662

[22] Filed: Oct. 11, 1988

[30] Foreign Application Priority Data

Oct. 13, 1987 [AU] Australia ..... PI4850

[51] Int. Cl.[4] ..... B07C 5/06

[52] U.S. Cl. ..... 209/621; 209/925; 209/620

[58] Field of Search ..... 209/620, 621, 622, 665, 209/924, 925, 933; 53/531, 534

[56] References Cited

U.S. PATENT DOCUMENTS 2,776,746 1/1957 Evoldsen ..... 209/620
3,587,854 6/1971 Brown et al. ..... 209/620
3,653,509 4/1972 Goodman et al. ..... 209/620 X
4,593,821 6/1986 Brulé209 ..... 620/

*Primary Examiner*—Margaret A. Focarino
*Assistant Examiner*—Gary C. Hoge
*Attorney, Agent, or Firm*—Rodman & Rodman

[57] ABSTRACT

A fruit grader comprising a plurality of belts which diverge away from a loading station and which overlie parallel and closely spaced transverse belts, all the belts being of a soft resilient elastomer, and where encountered by the fruit, being between supports so that they are easily deflected, thereby firstly limiting damage to the fruit due to impact and secondly limiting damage which can otherwise be caused by bounce when the direction of travel of the fruit is changed from longitudinal to transvers, bounce being inhibited due to the fruit entering the valleys between adjacent spaced parallel transverse belts.

10 Claims, 6 Drawing Sheets

FRUIT GRADING MACHINE

This invention relates to a fruit grader of the type wherein fruit is placed between belts which diverge in a downstream direction.

BACKGROUND OF THE INVENTION

Such fruit graders are known and for example the reader can refer to Australian patents 279301 Fairlie, 281144 Faringdon and the application 45270/72 Rowland and Rowland. The advantage of grading fruit with such a grader is that the fruit is less subject to damage than some other types of graders, and therefore such a grader is suitable for soft fruits such as apricots, peaches or strawberries.

Heretofore, however, fruit which has been released from belts has been dropped onto some hard surface for example a chute which is sloping towards a discharge position, and further handling has been required after grading.

This problem has been identified, and an effort has been made to overcome it by dropping longitudinally moving fruit onto a transversely moving flat conveyor belt of resilient foam, but further difficulties have been encountered, firstly in that the fruit tends to bounce on the foam as its direction of travel changes, and secondly in that foam is difficult to clean when partly dried fruit juice has penetrated the foam cells.

BRIEF SUMMARY OF THE INVENTION

The main object of this invention is to provide a grader of the diverging belt type wherein the damage to soft fruit is minimal, and wherein further handling and cleaning is reduced and in one embodiment of this invention a fruit grader comprises a loading station, a plurality of belts of soft resilient elastomer which are driven and which diverge in a longitudinal direction away from the loading station, and a plurality of banks of closely spaced belts also of soft resilient elastomer beneath the diverging belts and which extend transversely thereof, and respective drive means for the diverging belts and the transversely extending belts. The belts can conveniently comprise soft tubular polyurethane which can deflect under very small impact forces and is easily cleaned, thereby being less likely to inflict damage or contamination on the fruit.

In order to reduce the possibility of the bounce which occurs with a flat belt for example of cellular elastomer, and which can cause damage to the strawberries, the transverse belts are unsupported where they pass beneath the longitudinally extending belts, and the spacing is such that, if a item of fruit (for example a strawberry) drops onto the transverse belts, it will move to a position between two adjacent belts from which it will not bounce, but wherein its direction of travel will immediately be transverse. The term "transverse" is intended to indicate a direction of travel which is at right angles to the longitudinal direction, or which has a large transverse component of movement, and for example will include belts which extend at say 45° to the longitudinal direction.

Thus, in order to further reduce damage or contamination to fruit, in another embodiment a fruit grader comprises a plurality of belts diverging in a longitudinal direction, a plurality of banks of closely spaced transverse belts which pass unsupported beneath the longitudinally extending belts, all said belts being of circular section resilient elastomer, each bank of transverse belts being adjacent to at least one other bank of transverse belts but disposed longitudinally with respect thereto, and drive means so driving the belts that, in use, each item of fruit placed on the longitudinal belts is transported thereby and released onto a said bank of transverse belts which lies beneath that portion of the longitudinal belts where the space between them is sufficient for that item of fruit to drop, the elastomer being sufficiently soft and yieldable that the fruit, in dropping, is engaged by two adjacent belts and transported transversely without bounce.

An embodiment of the invention is described hereunder in some detail with reference to and is illustrated in the accompanying drawings in which.

Figure 1:
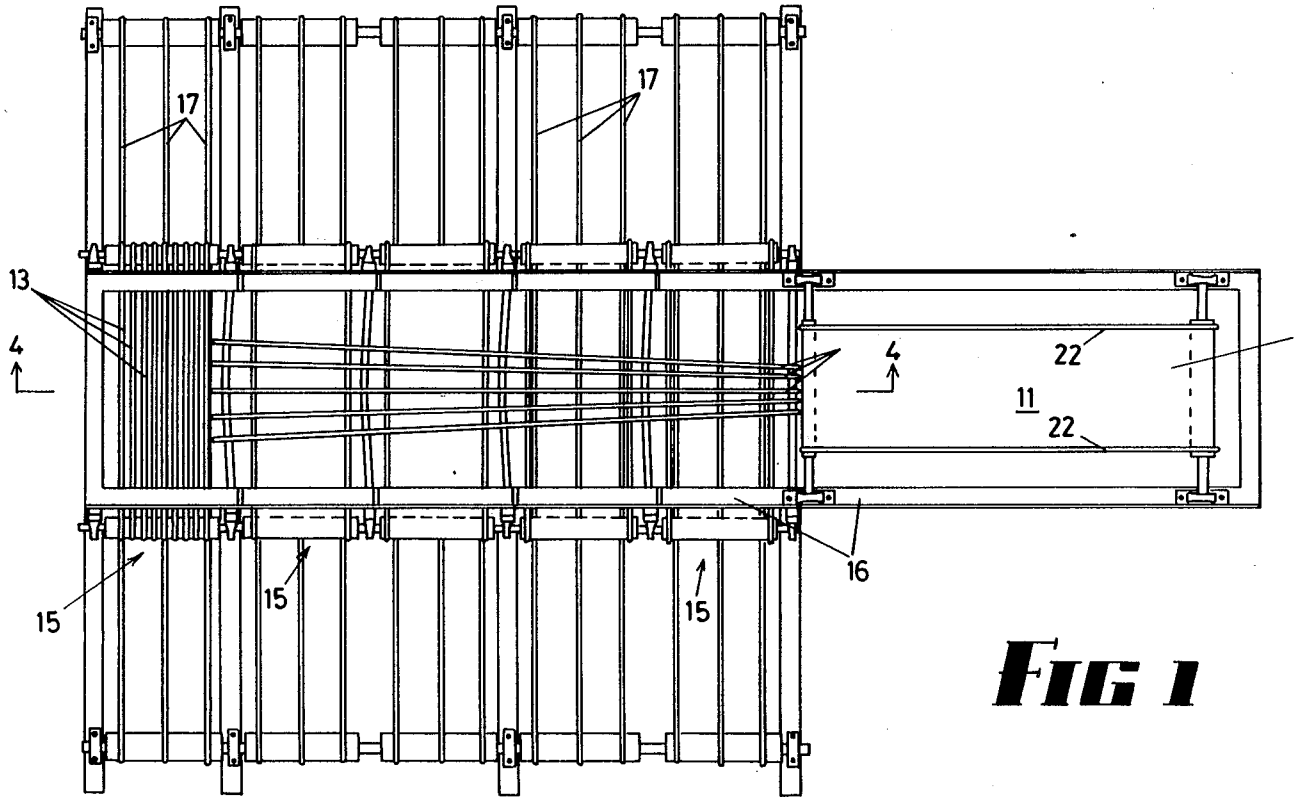
FIG. 1 is a diagrammatic plan view of a fruit grader according to a first embodiment.

In the first embodiment, a fruit grader 10 comprises a loading station 11 (FIGS. 1 and 2), a plurality of longitudinally extending belts 12 which diverge in a direction away from the loading station 11, and the upper traverse of a series of transverse belts 13 passes beneath the longitudinal belts 12 but is in close proximity thereto. The transverse belts 13 are carried in five banks designated 15 as shown in FIG. 1, and the belts are so driven that an item of fruit when placed on the longitudinal belts 12 will be discharged when the space between them is sufficiently wide for the item of fruit to drop, and the support means (described below) for the transverse belts 13 are spaced each side of the longitudinal belts 12 so that the transverse belts 13 are unsupported where they pass beneath the longitudinal belts 12, whereby the transverse belts 13 will readily deflect even upon the minor impact of a strawberry, so that fruit damage is minimal.

Figure 3:
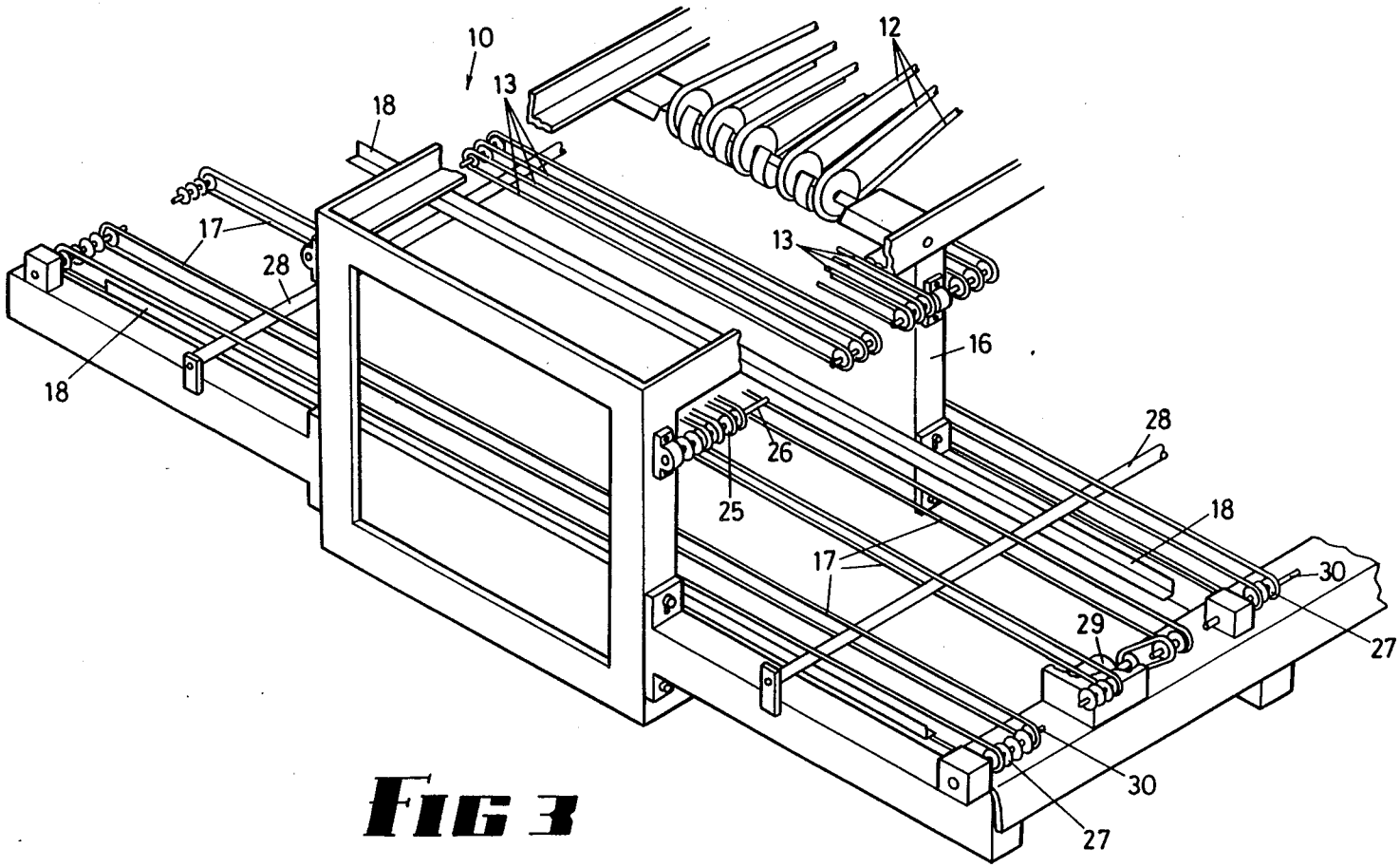
FIG. 3 is a fragmentary perspective view of the other end of the fruit grader.

The fruit grader is provided with a main frame 16 which is shown in some detail in FIG. 3, and the frame 16 supports third groups of belts 17 (also of tubular elastomer), these belts 17 lying in groups of three between angle section guides 18, there being one group beneath each respective bank 15. These belts perform the function of transporting trays or punnets beneath the respective banks 15 of transverse belts so that the fruit is discharged into those trays or punnets.

Figure 2:
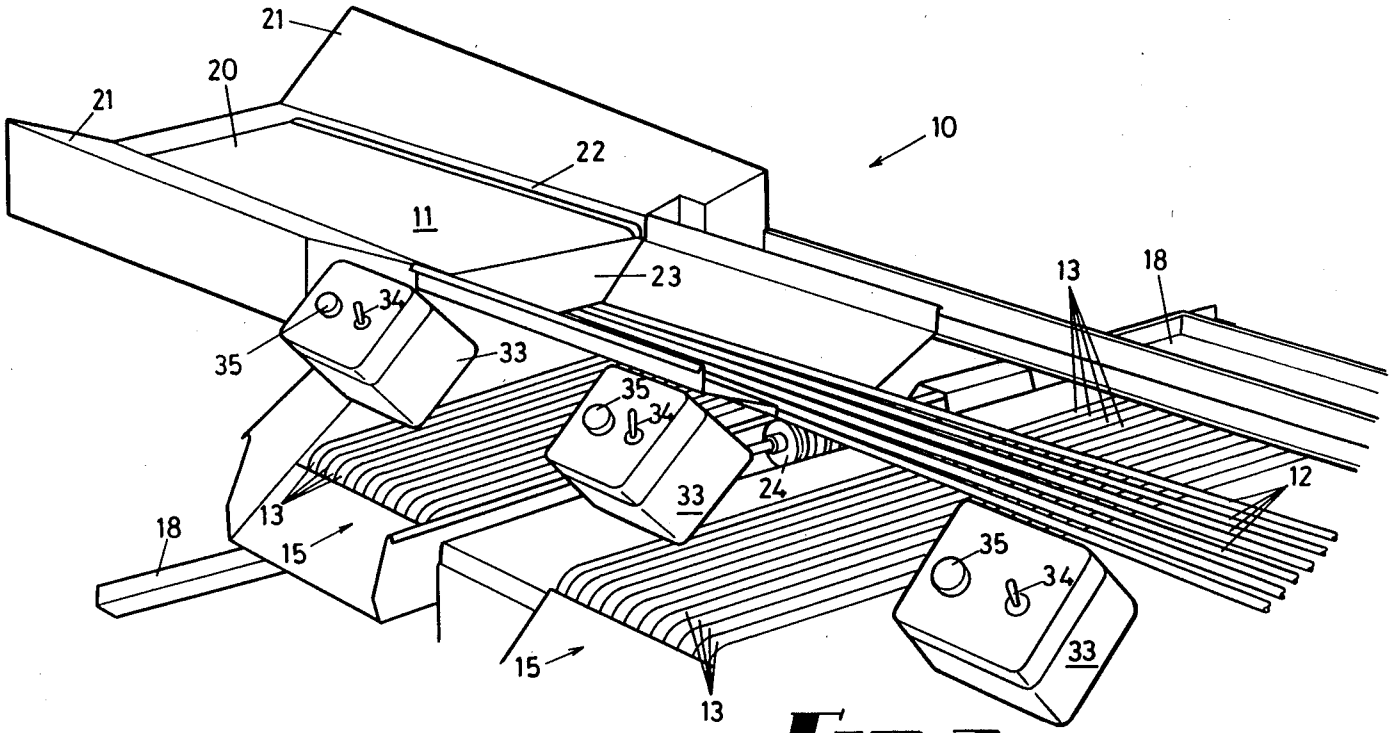
FIG. 2 is a fragmentary perspective view of the loading station end of the grader.

Reference is now made to FIG. 2 of the drawings wherein the loading station 11 will be seen to comprise a flat driven conveyor belt 20 which moves a short distance longitudinally between sloping side wings 21. Fruit such as strawberries is so delicate that it can be damaged by frictional engagement with the side wings, and consequently the conveyor belt 20 is flanked on each side by tubular bands 22 attached thereto, and these inhibit such frictional engagement.

When the fruit is discharged by the conveyor belt 20 onto the longitudinal belts 12, it passes over a short ramp 23 which slopes at a shallow angle, and encounters the longitudinal belts 12 between support means thereof so that the belts are easily deflected and do not impart bruising or other damage to the fruit. FIG. 2 shows one of several sets of rollers 24 which are freely rotatable and support respective longitudinal belts 12, but not where they could impart impact to the discharging fruit.

The fruit is discharged onto a respective bank 15 depending on the spacing between the longitudinal belts 12, and as shown in FIG. 3, the transverse belts 13 pass over rollers 25 at the ends of their traverse, and are unsupported intermediate the rollers 25. The rollers 25 are carried on driven shafts 26 which are driven to run constantly so long as the longitudinal belts 12 are driven to run constantly by drive means connected to rollers thereof, the drive means not being herein illustrated.

The lowermost sets of belts 17 are driven by rollers 27, but since these must transport trays, they require intermediate supports, and these take the form of freely rotating metal rollers 28 as shown in FIG. 3. Each bank of rollers 27 however is intermittently and separately driven by respective drive motors 29, there being one for each bank of rollers. The rollers 27 are carried on respective shafts 30 and V-belt drives 31 drive those shafts from the respective motors 29.

In the first embodiment control of the motors 29 is independent and manual, and FIG. 2 illustrates the switch boxes 33 each of which carries a switch 34 for continuous drive of the rollers 27, and also an inching button 35 for intermittent drive. The drive means for the longitudinal belts 12 and transverse belts 13 are not illustrated.

Figure 4:
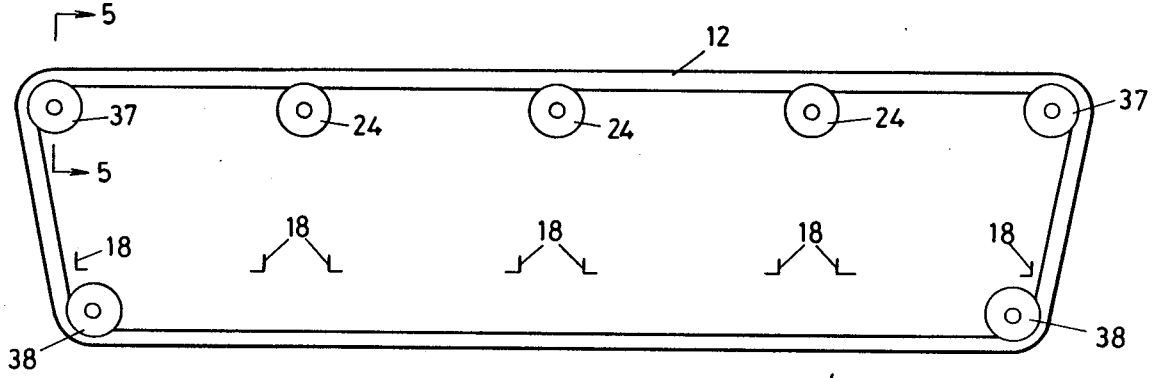
FIG. 4 is a diagrammatic section taken on plane 4—4 of FIG. 1.

The traverse of the belts 12 is illustrated in FIG. 4, the belts 12 being driven by one or more of the end rollers 37, passing over the support rollers 24, the belts 12 passing downwardly between the angle section guides 18, and over idlers 38 beneath the guides. Thus the trays or punnets pass beneath the upper traverse of the longitudinal belts 12 but above the lower traverse.

Figure 5:
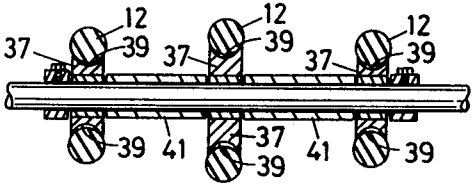
FIG. 5 is a fragmentary section taken on line 5—5 of FIG. 4 but drawn to a larger scale.

The rollers 24 and 37 are capable of interfering with the free passage of fruit if they are wider than the belts 12, and as shown in FIG. 5, the rollers 37 are no wider than the belts 12, preferably slightly narrower, and their peripheral surfaces 39 are concave.

If all the belts 12 travel at identical speeds, an item of fruit can lie between two adjacent longitudinal belts 12 being supported along its longer axis and not its shorter axis, and thereby irregular grading can occur. To overcome this problem, as best seen in FIG. 5, alternate rollers 37 at each end are larger than the other rollers 37 so that alternate belts move slightly faster than the other belts, thereby causing a slow rotation of each item of fruit as it is traversed by the longitudinal belts 12, and this will have the effect of ensuring that grading is effected with respect only to the smaller lateral dimension of fruit.

FIG. 5 also shows spacers 41 between adjacent rollers 37 at the diverging end of the longitudinal belts 12, and by varying those spacers 41 the degree of divergence can be varied so that any one machine can be used for a range of products of different sizes. Other working parts of the grader are also adjustable, including the feed chutes, the height and width of the tray feeds (by adjustment of position of the angle section guides 18), the machine is provided with levelling legs, and the speed of the machine can be adjusted by pulleys of varying size or by utilising a variable speed motor.

Desirably all the rollers which support the longitudinal belts 12 or transverse belts 13 are themselves formed of resilient elastomer so that in the unlikely event of impact by an item of fruit, there will be minimum bruising.

Figure 6:
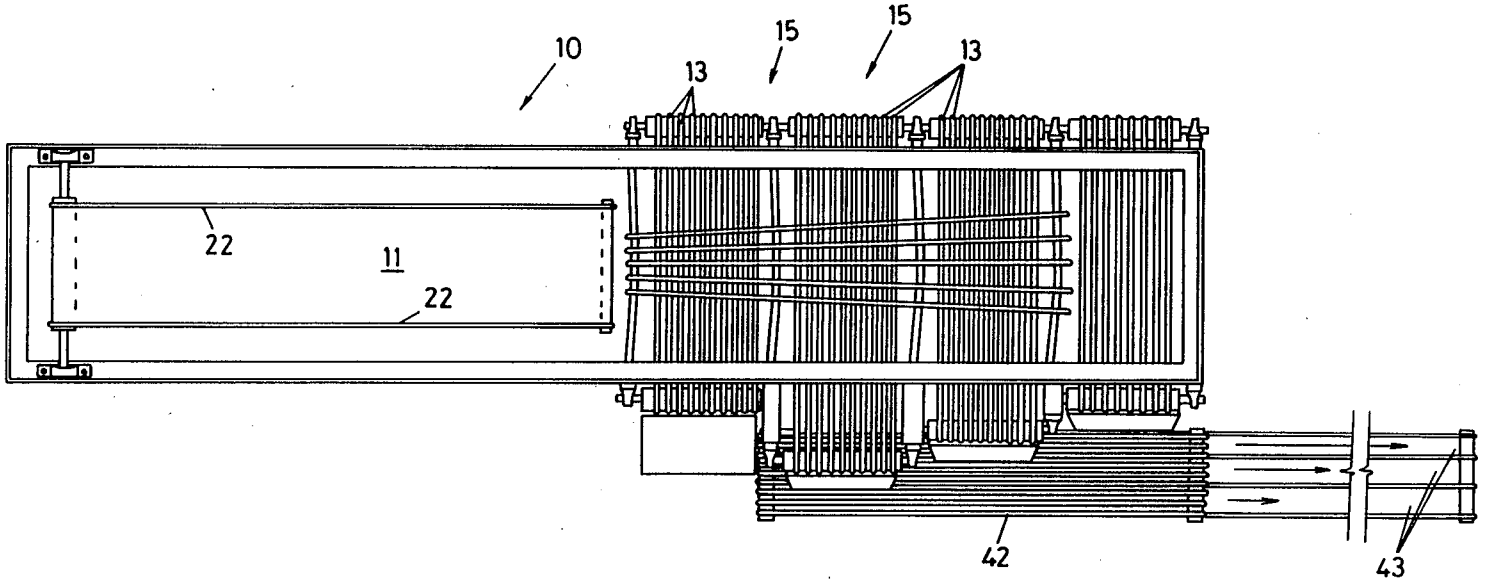
FIG. 6 is a view similar to FIG. 1 but showing a second embodiment which however incorporates the invention.

Reference is now made to the second embodiment of FIG. 6 which is generally similar to the first embodiment, but the banks 15 of transverse belts 13 are of different length and discharge onto further set of longitudinal belts 42 for packaging from different conveyor stations 43. In other respects the second embodiment is similar to the first.

Figure 7:
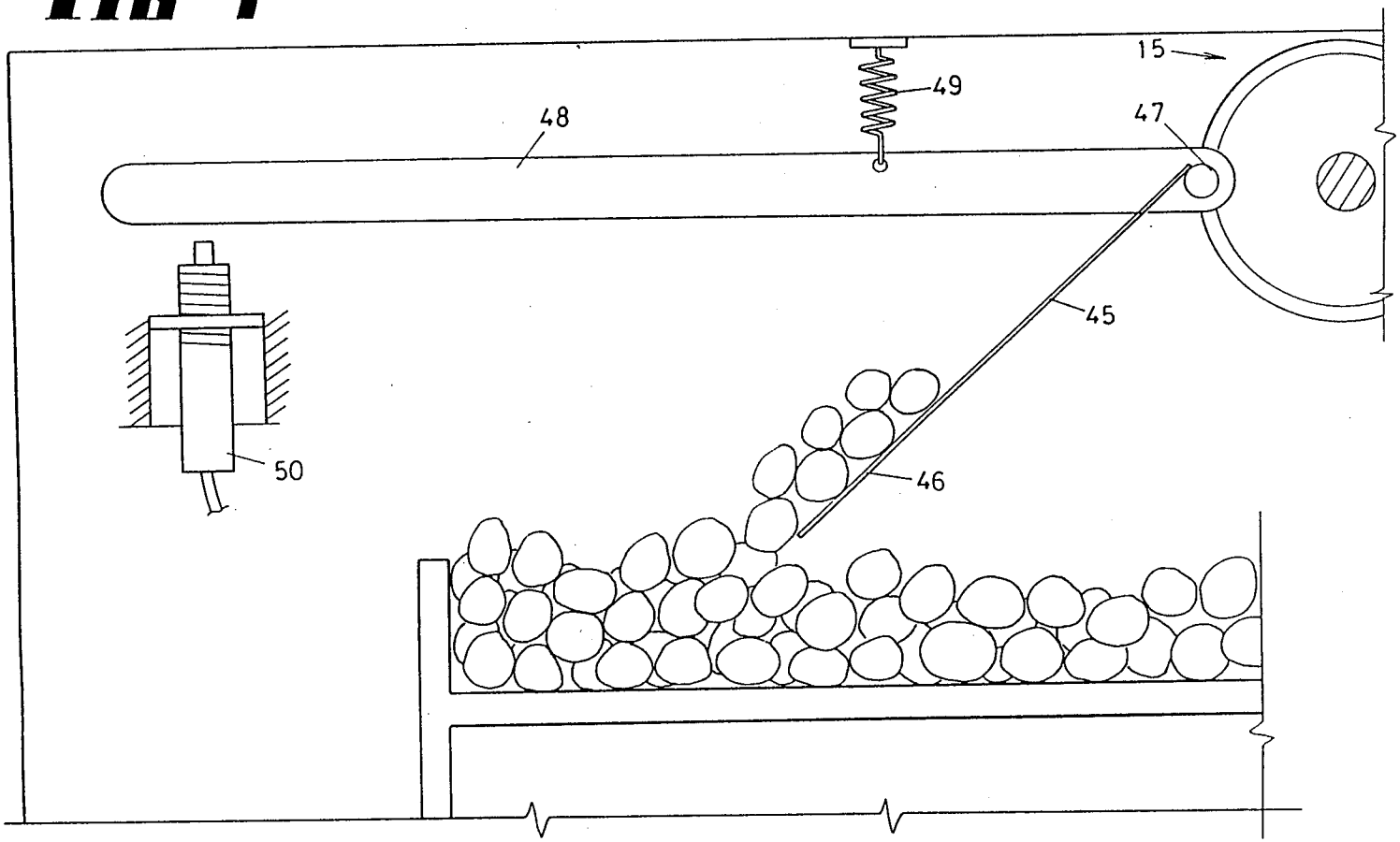
FIG. 7 is a diagrammatic section which shows a weight actuated switch for transversely transporting a tray or punnet.

In FIG. 7 there is illustrated a weight responsive chute 45 which has on its discharge end a flexible flap 46, the chute 45 being carried on a pivot shaft 47 which also carries a lever arm 48 which is balanced by means of a balancing spring 49, and this co-operates with a magnet responsive switch 50 to actuate the drive motor 29 for driving the relevant bank of belts 17 when it is necessary for the trays or punnets to be transported, this being indicated by a build-up of fruit on chute 45 when the trays or punnets are sufficiently filled. This reduces the need for manual control of the switches 34 and 35.

In some instances the invention will be used with trays which are movable along angle section guides and driven by the belts 17. However as shown in FIG. 3 there are a number of spare rollers 27 and additional belts 17 can be used to support sloping sided punnets between them if the packaging is to be into punnets.

The invention claimed is:

1. A fruit grader comprising a loading station, a plurality of belts of soft resilient elastomer which are driven and which diverge in a longitudinal direction away from the loading station, and a plurality of banks of closely spaced belts also of soft resilient elastomer beneath the diverging belts and which extend transversely thereof, and respective drive means for the diverging belts and the transversely extending belts.

2. A fruit grader comprising a plurality of belts diverging in a longitudinal direction, a plurality of banks of closely spaced transverse belts which pass unsupported beneath the longitudinally extending belts, all said belts being of circular section resilient elastomer, each bank of transverse belts being adjacent at least one other bank of transverse belts but disposed longitudinally with respect thereto, and drive means so driving the belts that, in use, each item of fruit placed on the longitudinal belts is transported thereby and released onto a said bank of transverse belts which lies beneath that portion of the longitudinal belts where the space between them is sufficient for that item of fruit to drop, the elastomer being sufficiently soft and yieldable that the fruit, in dropping, is engaged by two adjacent transverse belts and transported without bounce.

3. A fruit grader according to claim 2 further comprising rollers at the ends of the upper traverse of the longitudinal belts and supporting and driving the longitudinal belts, alternate rollers of those further rollers being larger in diameter than the other rollers at least at one said end of the belt upper traverse such that, when driven, those belts carried by the alternate rollers move faster than those belts carried by those other rollers.

4. A fruit grader according to claim 2 wherein said loading station comprises a pair of sloping side wings, a longitudinally extending conveyor belt between those side wings, and resilient tubular bands attached to and flanking the conveyor belt.

5. A fruit grader according to claim 3 wherein each said belt is a hollow tubular belt, each of said rollers at the ends of the upper traverse of the longitudinal belts is of resilient yieldable elastomer, its width does not exceed the diameter of the belt which it supports, and its periphery is concave.

6. A fruit grader according to claim 2 comprising a plurality of further groups of belts, each group lying beneath but extending transversely beyond a respective said bank, rollers supporting the further groups of belts, and separate drive means coupled to the rollers of each group to drive the belts thereof transversely independantly of the drive means of the other said groups.

7. A fruit grader according to claim 6 wherein each said drive means comprises a drive motor, and further comprising separate switches controlling operation of respective said drive motors.

8. A fruit grader according to claim 6 further comprising respective pairs of transversely extending guides flanking said further groups of belts and also extending transversely beyond the relevant said banks.

9. A fruit grader according to claim 2 comprising further sets of longitudinal belts in positions to longitudinally transport fruit discharged by respective said banks of transverse belts.

10. A fruit grader according to claim 2 further comprising weight responsive chutes beneath the discharge ends of respective said banks of transverse belts, each said weight responsive chute being movable in response to the weight of fruit it supports, respective magnetic switch means adjacent the chutes and arranged to be actuated by said movement thereof, and respective container drive means arranged to be energised upon closure of said switch means due to buildup of fruit on respective chutes when the trays or punnets beneath them are sufficiently filled, in such a way as to progress fruit containers transversely beneath respective said chutes for filling with fruit from the chutes when those fruit containers are on the fruit grader and movable by the drive means.

* * * * *